US009897412B1

(12) United States Patent
Cicero, Jr.

(10) Patent No.: US 9,897,412 B1
(45) Date of Patent: Feb. 20, 2018

(54) FIREARMS RETENTION SYSTEM

(71) Applicant: Richard J. Cicero, Jr., Weeki Wachee, FL (US)

(72) Inventor: Richard J. Cicero, Jr., Weeki Wachee, FL (US)

( * ) Notice: Subject to any disclaimer, the term of this patent is extended or adjusted under 35 U.S.C. 154(b) by 0 days.

(21) Appl. No.: 15/095,259

(22) Filed: Apr. 11, 2016

Related U.S. Application Data

(60) Provisional application No. 62/162,336, filed on May 15, 2015.

(51) Int. Cl.
*F41C 33/00* (2006.01)
*F41C 33/02* (2006.01)
*F41C 33/04* (2006.01)

(52) U.S. Cl.
CPC ..... *F41C 33/0263* (2013.01); *F41C 33/041* (2013.01); *F41C 33/046* (2013.01)

(58) Field of Classification Search
CPC ..... F41C 33/007; F41C 33/06; F41C 23/02; F41C 33/006; A45F 2005/026; A45F 5/02; A45F 5/021; A45F 5/00; Y10S 224/913
See application file for complete search history.

(56) References Cited

U.S. PATENT DOCUMENTS 476,246 A * 6/1892 Burgess ..... F41A 9/18 224/255
6,786,372 B2 * 9/2004 Enkerlin ..... A45F 5/02 224/196
8,910,410 B2 * 12/2014 Peters ..... F41C 33/006 224/197
2013/0105527 A1 * 5/2013 Rekuc ..... A45C 15/00 224/183

* cited by examiner

*Primary Examiner* — Adam Waggenspack

(57) ABSTRACT

A fixed assembly includes a locking pin in a cylindrical configuration and formed with an annular recess. A movable assembly includes an interior sub-assembly and an exterior sub-assembly. The exterior sub-assembly has parallel side walls forming an exterior chamber. A first aperture passes through the parallel side walls. A hollow cylinder in the first aperture is aligned with the first aperture. The hollow cylinder is adapted to removably receive the locking pin. The hollow cylinder has a radial hole aligned with the annular recess when the locking pin is within the hollow cylinder. The interior sub-assembly has opposed plates forming an interior chamber. A lever is pivotably mounted within the interior chamber. The lever has an arcuate section rotatable between an advanced position into the annular recess to lock the locking pin. The arcuate section is rotatable to a retracted position withdrawn from the annular recess.

1 Claim, 4 Drawing Sheets

FIG. 1
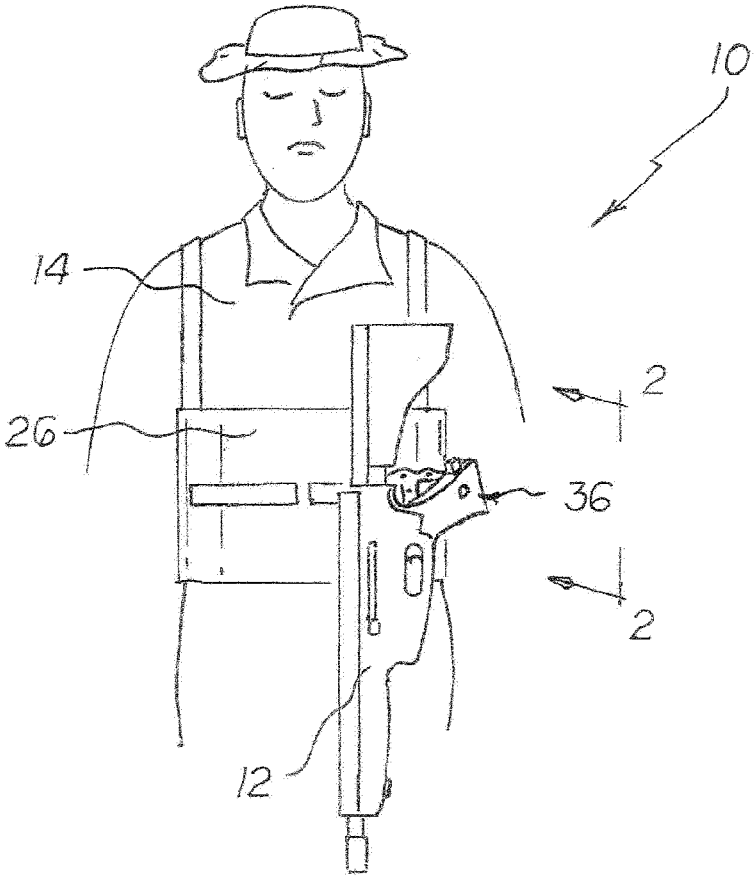
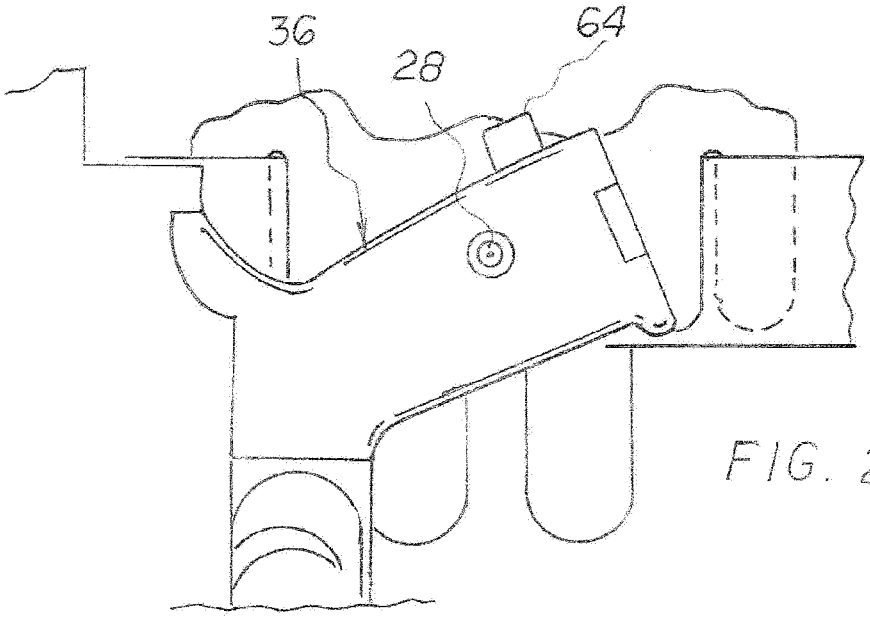
FIG. 2

FIREARMS RETENTION SYSTEM

RELATED APPLICATION

The present non-provisional application is based upon Provisional Application No. 62/162,336 filed May 15, 2015, the priority of which is claimed and the subject matter of which is incorporated herein by reference.

BACKGROUND OF THE INVENTION

Field of the Invention

The present invention relates to a firearms retention system and more particularly pertains to releasably coupling a firearm to an individual hands-free and for maintaining the firearm safely pointing downwardly while coupled in a safe, convenient, and economical manner.

Description of the Prior Art

The use of firearms retention systems of known designs and configurations is known in the prior art. More specifically, firearms retention systems of known designs and configurations previously devised and utilized for the purpose of providing control and stability of a firearm are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a firearms retention system that allows releasably coupling a firearm to an individual hands-free and maintaining the firearm safely pointing downwardly while coupled in a safe, convenient, and economical manner.

In this respect, the firearms retention system according to the present invention substantially departs from the conventional concepts and designs of the prior art, and in doing so provides an apparatus primarily developed for the purpose of releasably coupling a firearm to an individual hands-free and maintaining the firearm safely pointing downwardly while coupled in a safe, convenient, and economical manner.

Therefore, it can be appreciated that there exists a continuing need for a new and improved firearms retention system which can be used for releasably coupling a firearm to an individual hands-free and for maintaining the firearm safely pointing downwardly while coupled in a safe, convenient, and economical manner.

In this regard, the present invention substantially fulfills this need.

SUMMARY OF THE INVENTION

In view of the foregoing disadvantages inherent in the known types of firearms retention systems of known designs and configurations now present in the prior art, the present invention provides an improved firearms retention system. As such, the general purpose of the present invention, which will be described subsequently in greater detail, is to provide a new and improved firearms retention system and method which has all the advantages of the prior art and none of the disadvantages.

To attain this, for a broad perspective, the present invention essentially comprises a fixed assembly including a locking pin in a cylindrical configuration and formed with an annular recess. A movable assembly includes an interior sub-assembly and an exterior sub-assembly. The exterior sub-assembly has parallel side walls forming an exterior chamber. A first aperture passes through the parallel side walls. A hollow cylinder in the first aperture is aligned with the first aperture. The hollow cylinder is adapted to removably receive the locking pin. The hollow cylinder has a radial hole aligned with the annular recess when the locking pin is within the hollow cylinder. The interior sub-assembly has opposed plates forming an interior chamber. A lever is pivotably mounted within the interior chamber. The lever has an arcuate section rotatable between an advanced position into the annular recess to lock the locking pin. The arcuate section is rotatable to a retracted position withdrawn from the annular recess.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved firearms retention system which has all of the advantages of the prior art firearms retention systems of known designs and configurations and none of the disadvantages.

It is another object of the present invention to provide a new and improved firearms retention system which may be easily and efficiently manufactured and marketed.

It is a further object of the present invention to provide a new and improved firearms retention system which is of durable and reliable constructions.

An even further object of the present invention is to provide a new and improved firearms retention system which is susceptible of a low cost of manufacture with regard to both materials and labor, and which accordingly is then susceptible of low prices of sale to the consuming public, thereby making such firearms retention system economically available to the buying public.

Lastly, it is an object of the present invention to provide a firearms retention system for releasably coupling a firearm to an individual hands-free and for maintaining the firearm safely pointing downwardly while coupled in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a firearms retention system constructed in accordance with the principles of the present invention, the system being illustrated while releasably coupled to an individual.

FIG. 2 is an enlarged side elevational view taken along line 2-2 of FIG. 1.

The same reference numerals refer to the same parts throughout the various Figures.

DESCRIPTION OF THE PREFERRED EMBODIMENT

Figure 3:
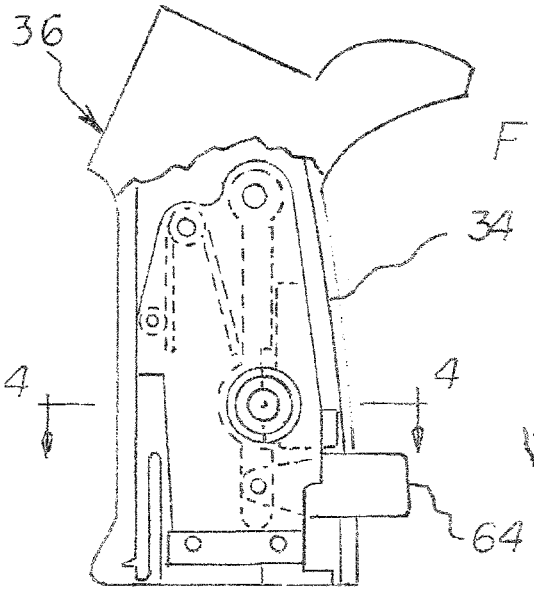
FIG. 3 is an enlarged front elevational view of the movable assembly of the system with parts broken away to show certain internal components.
Figure 4:
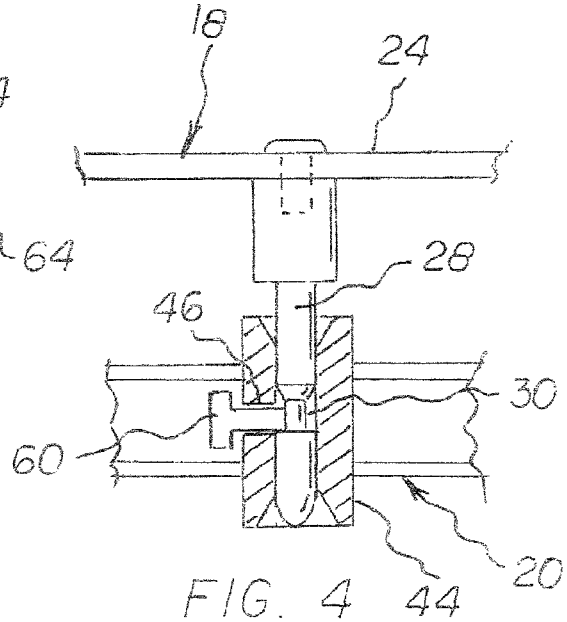
FIG. 4 is a cross sectional view taken along line 4-4 of FIG. 3 illustrating the coupling between the fixed assembly and the movable assembly.
Figure 5:
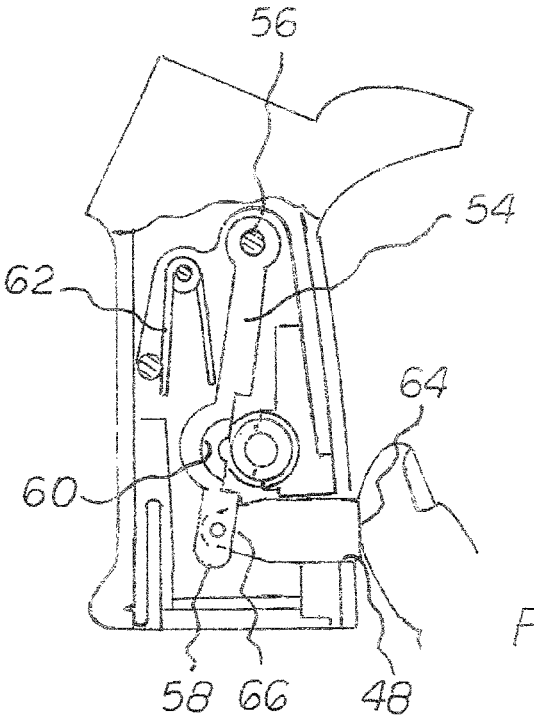
FIG. 5 is an enlarged front elevational view similar to FIG. 3 but with the movable assembly ready for separation.
Figure 6:
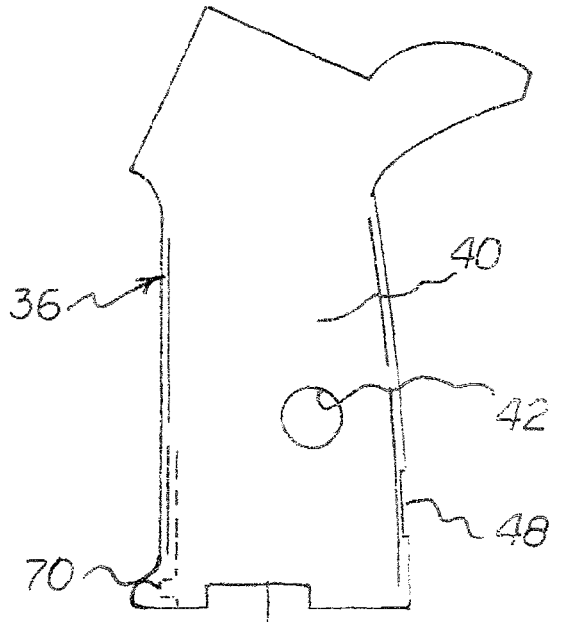
FIG. 6 is an exploded side elevational view of the movable assembly illustrating the exterior sub-assembly and the interior sub-assembly.
Figure 7:
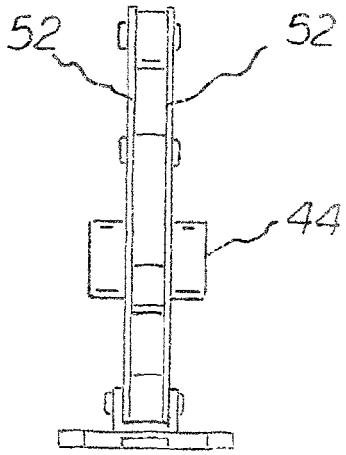
FIG. 7 is a side elevational view of the interior sub-assembly.
Figure 8:
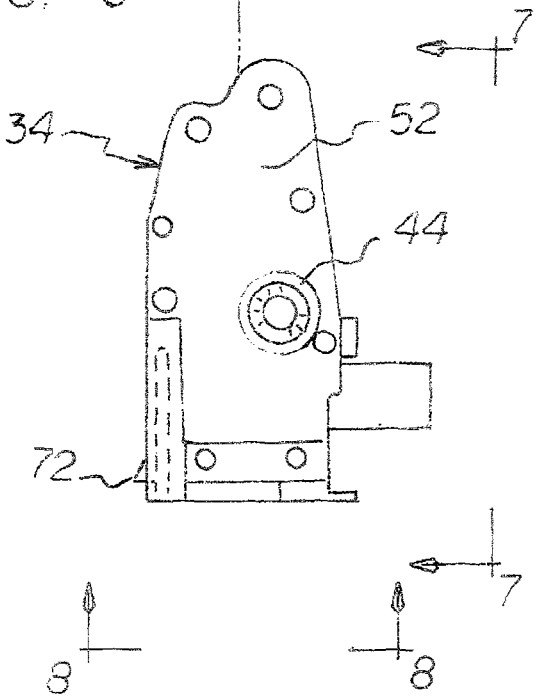
FIG. 8 is a bottom view of the interior sub-assembly taken along line 7-7 of FIG. 6.
Figure 8:
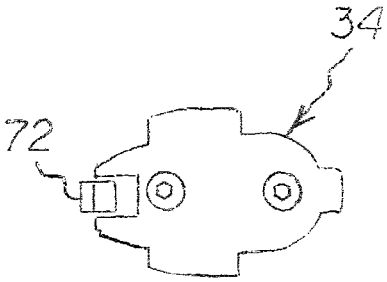
Figure 9:
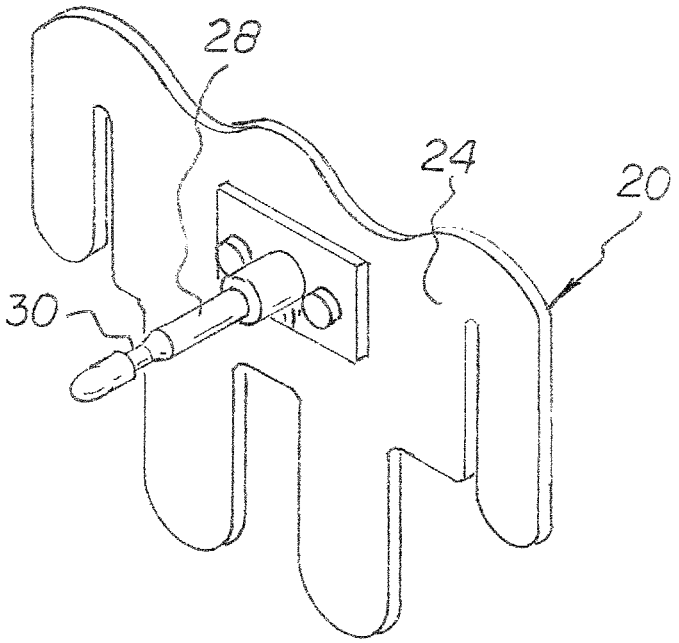
FIG. 9 is a perspective illustration of the fixed assembly.

With reference now to the drawings, and in particular to FIG. 1 thereof, the preferred embodiment of the new and improved firearms retention system embodying the principles and concepts of the present invention and generally designated by the reference numeral 10 will be described.

The present invention, the firearms retention system 10 is comprised of a plurality of components. Such components in their broadest context include a fixed assembly and a movable assembly. Such components are individually configured and correlated with respect to each other so as to attain the desired objective.

From a specific perspective, the invention of the present application is a firearms retention system 10 for releasably coupling a firearm 12 to an individual 14 hands-free and for maintaining the firearm safely pointing downwardly while coupled. The releasable coupling and the safely pointing are done in a safe, convenient, and economical manner. First provided are a fixed assembly 18 and a movable assembly 20. The movable assembly is releasably coupled to the fixed assembly.

The fixed assembly 18 includes a base 24 and a vest 26. The vest is adapted to be worn by the individual. The base is attached to the vest. The fixed assembly also includes a locking pin 28. The locking pin has a cylindrical configuration over the majority of its length. The locking pin has an interior end attached to the base waist high and extending laterally from the individual. The locking pin has an exterior end in a generally hemispherical configuration. The locking pin has a central section formed with an annular recess 30. The locking pin has a fixed length.

The movable assembly 20 includes an interior sub-assembly 34 and an exterior sub-assembly 36. The exterior sub-assembly has a generally rectilinear configuration with an upper end, a lower end, and parallel side walls 40 forming an exterior chamber between the parallel side walls. The upper end is coupled to a firearm to constitute a grip. The lower end is open to create a passageway to the exterior chamber. A first aperture 42 passes through the parallel side walls at a central extent. A hollow cylinder 44 is aligned with the first aperture. The hollow cylinder has an input end and an output end. The input end is adapted to removably receive the locking pin. The hollow cylinder has a radial hole 46 within the exterior chamber. The radial hole is aligned with the annular recess when the locking pin is within the hollow cylinder. A rearwardly facing button hole 48 is provided in the exterior sub-assembly.

The interior sub-assembly 36 has opposed plates 52 forming an interior chamber. A lever 54 is provided within the interior chamber. The lever has a first end with a pivot pin 56 pivotably attaching the lever to the opposed plates. The lever has a second end 58. The lever has an arcuate section 60 rotatable between an advanced position passing through the radial hole and into the annular recess to lock the locking pin to the movable assembly and to lock the firearm to the individual in ready anticipation of use. The arcuate section is rotatable to a retracted position withdrawn from the annular recess and the hollow cylinder to allow removal of the locking pin from the hollow cylinder and from the movable assembly in order to free the firearm for use by the individual. A spring 62 is provided. The spring urges the lever to the advanced position. A release button 64 is provided within the interior chamber. The release button has an inner end 66 pivotably secured to the exterior end of the lever. The release button has an outer end passing through the movable assembly adapted to be depressed by the individual to move the lever to the retracted position whereby the individual may separate the firearm for use.

Lastly, separation components are provided. The separation components include a separator recess 70 in the exterior sub-assembly at a lower extent. The separation components also include a spring urged finger 72 on the movable assembly movable to a position within the separation recess to hold together the interior and exterior sub-assemblies. The spring urged finger is movable to a position out of the separation recess to allow separation of the interior and exterior sub-assemblies.

Figure 10:
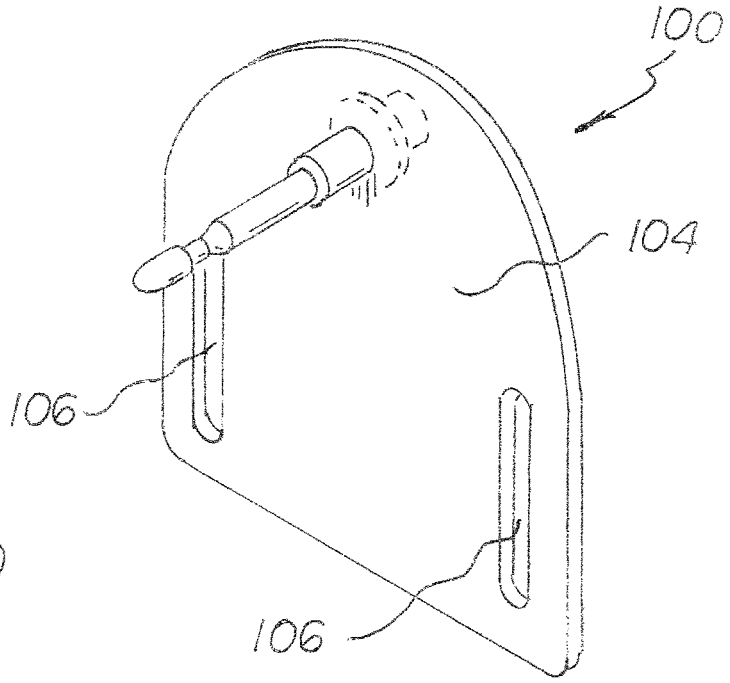
FIG. 10 is a perspective illustration of a fixed assembly constructed in accordance with an alternate embodiment of the invention.

FIG. 10 illustrates an alternate embodiment of the invention 100. In this embodiment, the base 104 includes slots 106 for coupling to a belt. Note is taken that the base may be formed as part of a vest or coupled to an individual through a belt or through any of a plurality of other techniques. Further, although the primary embodiment of the invention is as original equipment integrally fabricated with the firearm, it should be understood that the present invention is also adapted to be used as a retrofit to any existing firearm.

When a firearm is slung and the individual needs both hands, the firearm swings without control and there is limited retention. The present invention solves this problem. The present invention keeps the firearm close to the individual's body and prevents it from swinging. The present invention also provides hands-free control and stability of the firearm where there had been none previously.

The grip system of the present invention attaches to a low profile pin on a tactical vest or belt. Once attached it can only be removed by depressing a button, giving the individual the ability to use both hands freely while maintaining control of the firearm.

The claimed invention differs from what currently exists. There are no other devices of this type. Previously, the individual was required to use one hand to maintain control of the firearm. This invention is an improvement on what currently exists. There are no other devices of this type. There are no other devices specific in this field. This device provides hands-free control and stability of the firearm where there had been none previously. The firearm specific grip of the present invention requires no modification to the firearm of choice. This changes little to none of the appearance of the firearm and has no impact on the operation of the firearm. The individual may be any operator including a soldier, police officer, security agent, or pleasure shooter.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A firearms retention system (10) for releasably coupling a firearm (12) to an individual (14) hands-free and for maintaining the firearm safely pointing downwardly while coupled, the releasable coupling and the safely pointing being done in a safe, convenient, and economical manner, the system comprising, in combination:

a fixed assembly (18) and a movable assembly (20), the movable assembly being releasably coupled to the fixed assembly;

the fixed assembly (18) including a base (24) and a vest (26), the vest adapted to be worn by the individual, the base being attached to the vest, the fixed assembly also including a locking pin (28), the locking pin having a cylindrical configuration over the majority of its length, the locking pin having an interior end attached to the base waist high and extending laterally from the individual, the locking pin having an exterior end that is tapered, the locking pin having a central section formed with an annular recess (30), the locking pin having a fixed length;

the movable assembly (20) including an interior sub-assembly (34) and an exterior sub-assembly (36);

the exterior sub-assembly having an upper end and a lower end and parallel side walls (40) forming an exterior chamber between the parallel side walls, the upper end being coupled to a firearm to constitute a grip, the lower end being open to create a passageway to the exterior chamber, a first aperture (42) passing through the parallel side walls at a central extent, a hollow cylinder (44) aligned with the first aperture, the hollow cylinder having an input end and an output end, the input end adapted to removably receive the locking pin, the hollow cylinder having a radial hole (46) within the exterior chamber, the radial hole being aligned with the annular recess when the locking pin is within the hollow cylinder, a rearwardly facing button hole (48) in the exterior sub-assembly;

the interior sub-assembly 36 having opposed plates (52) forming an interior chamber, a lever (54) within the interior chamber, the lever having a first end with a pivot pin 56 pivotably attaching the lever to the opposed plates, the lever having a second end (58), the lever having an arcuate section (60) rotatable between an advanced position passing through the radial hole and into the annular recess to lock the locking pin to the movable assembly and to lock the firearm to the individual in ready anticipation of use, the arcuate section being rotatable to a retracted position withdrawn from the annular recess and the hollow cylinder to allow removal of the locking pin from the hollow cylinder and from the movable assembly in order to free the firearm for use by the individual, a spring (62) urging the lever to the advanced position, a release button (64) within the interior chamber having an inner end (66) pivotably secured to the exterior end of the lever, the release button having an outer end passing through the movable assembly adapted to be depressed by the individual to move the lever to the retracted position whereby the individual may separate the firearm for use; and separation components including a separator recess (70) in the exterior sub-assembly at a lower extent, the separation components also including a spring urged finger (72) on the movable assembly movable to a position within the separation recess to hold together the interior and exterior sub-assemblies, the spring urged finger movable to a position out of the separation recess to allow separation of the interior and exterior sub-assemblies.

* * * * *